US011114064B2

(12) United States Patent
Chen et al.

(10) Patent No.: US 11,114,064 B2
(45) Date of Patent: Sep. 7, 2021

(54) DISPLAY DEVICE AND DRIVING METHOD THEREOF

(71) Applicant: AU Optronics Corporation, Hsin-Chu (TW)

(72) Inventors: Kuan-Hsun Chen, Hsin-Chu (TW); Yu-Sheng Huang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/069,959

(22) Filed: Oct. 14, 2020

(65) Prior Publication Data

US 2021/0210050 A1 Jul. 8, 2021

(30) Foreign Application Priority Data

Jan. 2, 2020 (TW) ..... 109100104

(51) Int. Cl.
*G09G 5/10* (2006.01)

(52) U.S. Cl.
CPC ..... *G09G 5/10* (2013.01); *G09G 2320/0233* (2013.01); *G09G 2320/0626* (2013.01)

(58) Field of Classification Search
CPC ..... G09G 5/10; G09G 2320/0626; G09G 2320/0233; G09G 3/3258; G09G 2370/16; H01Q 21/00
See application file for complete search history.

(56) References Cited

U.S. PATENT DOCUMENTS

| | | | | |
|---|---|---|---|---|
| 6,885,345 | B2 * | 4/2005 | Jackson | H01Q 3/40 343/700 MS |
| 9,852,691 | B2 * | 12/2017 | Hyun | H02J 5/005 |
| 10,276,088 | B2 * | 4/2019 | Li | G09G 3/22 |
| 10,327,341 | B2 * | 6/2019 | Suzuki | H05K 5/0017 |
| 10,636,360 | B2 * | 4/2020 | Hsu | H05K 1/0213 |
| 10,679,563 | B2 * | 6/2020 | Cho | H01L 27/326 |
| 10,701,815 | B2 * | 6/2020 | Suzuki | H01Q 1/2283 |
| 10,714,013 | B2 * | 7/2020 | Huang | H01Q 1/525 |
| 10,741,127 | B2 * | 8/2020 | Huang | H01Q 1/2283 |
| 10,803,805 | B2 * | 10/2020 | Cho | G09G 3/32 |
| 2010/0079416 | A1 * | 4/2010 | Chung | G09G 3/2085 345/204 |
| 2014/0106684 | A1 * | 4/2014 | Burns | H01Q 21/28 455/78 |

(Continued)

FOREIGN PATENT DOCUMENTS

| | | | |
|---|---|---|---|
| CN | 105024746 | A | 11/2015 |
| TW | I697878 | B | 7/2020 |

*Primary Examiner* — Rodney Amadiz
(74) *Attorney, Agent, or Firm* — WPAT, PC

(57) ABSTRACT

A display device includes a pixel circuit and receiving antenna units. The pixel circuit is disposed in the active area, and the pixel circuit includes pixel units. The receiving antenna units are electrically connected to the pixel circuit. The receiving antenna units include a first receiving antenna unit and a second receiving antenna unit. The first receiving antenna unit is configured to provide a first data signal to the pixel units in a first part, and the pixel units in the first part are configured to illuminate at a first brightness. The second receiving antenna unit is configured to provide a second data signal to the pixel units in a second part, and the pixel units in the second part are configured to illuminate at a second brightness.

22 Claims, 9 Drawing Sheets

(56) References Cited

U.S. PATENT DOCUMENTS

| | | | | |
|---|---|---|---|---|
| 2015/0326061 | A1 | 11/2015 | Davison et al. | |
| 2018/0301106 | A1 | 10/2018 | Huang et al. | |
| 2019/0250470 | A1* | 8/2019 | Huang | G02F 1/133514 |

* cited by examiner

100

DISPLAY DEVICE AND DRIVING METHOD THEREOF

CROSS-REFERENCE TO RELATED APPLICATION

This application claims priority to Taiwan Application Serial Number 109100104, filed Jan. 2, 2020, which is herein incorporated by reference in its entirety.

BACKGROUND

Field of Invention

The present invention relates to a display device and a driving method thereof. More particularly, the present invention relates to a wireless display device with an antenna design and a driving method thereof.

Description of Related Art

Among techniques of display panel nowadays, the display panel in the mainstream is designed to have large size and high resolution. To increase the size of display area of the display panel and narrow down a surrounding bezel area of the display panel, techniques of wireless transmission are utilized to transmit display data. However, on a display device with its display data transmitted wirelessly, a problem of non-uniform brightness may occur. As a result, it is desired to have a method to solve the non-uniform brightness issue on the display device with its display data transmitted wirelessly.

SUMMARY

A first embodiment of the present disclosure is to provide a display device. The display device includes a pixel circuit and multiple receiving antenna units. The pixel circuit is disposed on an active area. The pixel circuit includes multiple pixel units. The multiple receiving antenna units are electrically coupled to the pixel circuit. The multiple receiving antenna units include a first receiving antenna unit and a second receiving antenna unit. The first receiving antenna unit is configured to provide a first data signal to the pixel units in a first part for driving the pixel units in the first part to illuminate at a first brightness. The second receiving antenna unit is configured to provide a second data signal to the pixel units in a second part for driving the second part of the pixel units in the second part to illuminate at a second brightness. Wherein, during a first frame, a first phase difference exists between the first data signal and the second data signal, the pixel units in the first part are configured to illuminate the first brightness according to the first data signal with the first phase difference; the pixel units in the second part are configured to illuminate the second brightness according to the second data signal with the first phase difference.

A second embodiment of the present disclosure is to provide a display device. The display device includes a pixel circuit and multiple receiving antenna units. The pixel circuit is disposed on an active area. The pixel circuit includes multiple pixel units. The multiple receiving antenna units are electrically coupled to the pixel circuit. The multiple receiving antenna units include a first receiving antenna unit and a second receiving antenna unit. The first receiving antenna unit is configured to provide a first data signal to a first pixel unit of the pixel units in a first part for driving one of the pixel units in the first part to illuminate at a first brightness. The second receiving antenna unit is configured to provide a second data signal to a second pixel of the pixel units in a second part for driving one of the pixel units in the second part to illuminate at a second brightness. Wherein, during a first frame, a first phase difference exists between the first data signal and the second data signal, the first pixel unit is configured to illuminate at the first brightness according to the first data signal with the first phase difference, the second pixel unit is configured to illuminate at the second brightness according to the second data signal with the first phase difference.

A third embodiment of the present disclosure is to provide a driving method of a display device. The driving method includes: providing a first data signal by a first receiving antenna unit to a plurality of pixel units in the a first part; providing a second data signal by a second receiving antenna unit to the plurality of the pixel units in a second part; and during a first frame, a first phase difference exists between the first data signal and the second data signal, the plurality of pixel units in the first part are configured to illuminate the first brightness according to the first data signal with the first phase difference; the plurality of pixel units in the second part are configured to illuminate the second brightness according to the second data signal with the first phase difference.

The display device and the driving method thereof of the present disclosure mainly utilize the phase difference between the individual signals during transmission of these individual signals to control the brightness of the display image. In this way, an average brightness of the display device in the continuous time can be maintained at a level roughly equal to a brightness reference value, such that continuous frames displayed on the display device may achieve constant brightness in user's visions.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
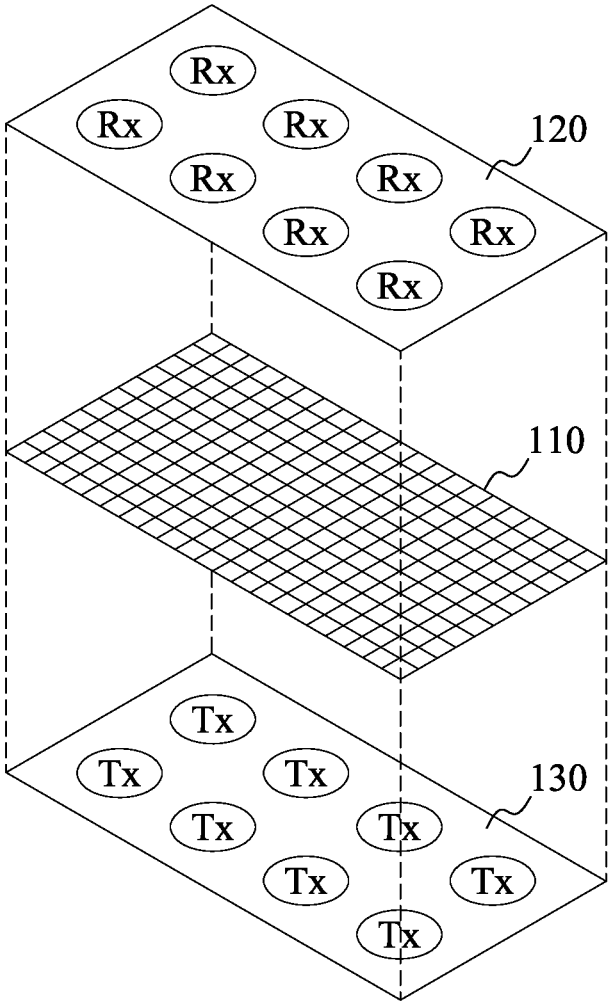
FIG. 1 is a schematic diagram illustrating a display device according to an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1. FIG. 1 is a schematic diagram illustrating a display device 100 according to an embodiment of the present disclosure. As shown in FIG. 1, a display device 100 includes a pixel circuit 110, a receiving antenna structure 120 and an emission antenna structure 130. The receiving antenna structure 120 includes multiple receiving antenna units Rx. The emission antenna structure includes multiple emission antenna units Tx. In an embodiment, the emission antenna structure 130 is disposed on the backlight array (not shown), such that the emission antenna structure 130 is spatially separated from the receiving antenna structure 120. It is noted that, each of the emission antenna units Tx corresponds one-to-one with each of the receiving antenna units Rx. As a result, one of the emission antenna units Tx and one corresponding receiving antenna unit Rx operate with an identical oscillation frequency between each other.

Figure 2:
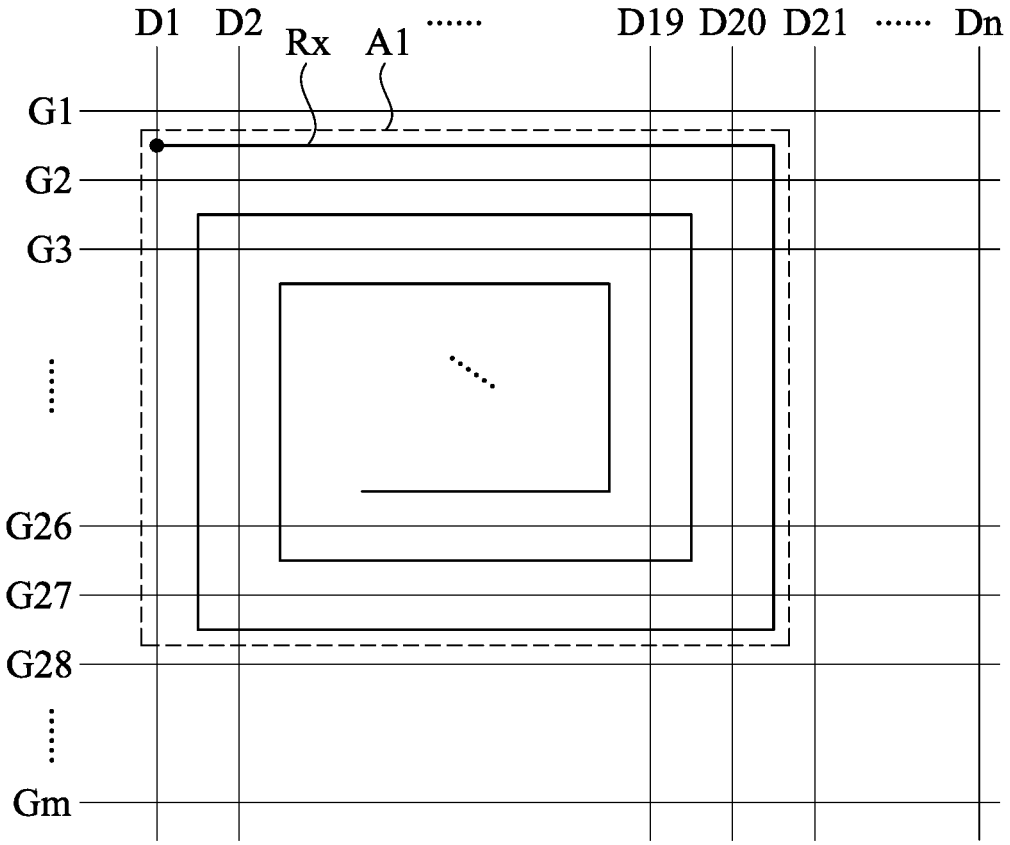
FIG. 2 is a schematic diagram illustrating pixel units and a receiving antenna unit according to an embodiment of the present disclosure.

Reference is made to FIG. 2. FIG. 2 is a schematic diagram illustrating pixel units and a receiving antenna unit according to an embodiment of the present disclosure. In an embodiment, the pixel circuit 110 is disposed on an active area (AA) of the display device 100. The pixel circuit 110 includes M gate lines G1~Gm, N data lines D1~Dn and multiple pixel units, wherein M and N are positive integer. One receiving antenna unit Rx and one emission antenna unit Tx (not shown) correspond to a part of the pixel units. As shown in FIG. 2, one receiving antenna unit Rx corresponds to multiple the pixel units disposed in an area A1, and the area A1 is located on a rectangular block over the $1^{st}$ data line D1 to the $20^{th}$ data line D20 and over the $1^{st}$ gate line G1 to the $27^{th}$ gate line G27.

Similarly, the other receiving antenna unit Rx corresponds to the multiple pixel units located on an area A2, the area A2 (not shown) is located on another rectangular block over the $21^{th}$ data line D20 to the $40^{th}$ data line D40 and over the $1^{st}$ gate line G1 to the $27^{th}$ gate line G27. It is noted that, the area A1 and A2 above are one example for demonstration. In some other cases, the boundary of the area A1 and A2 can be adjusted according to the size of the antenna, and therefore the scope of the present disclosure should not be limited thereto.

Figure 3:
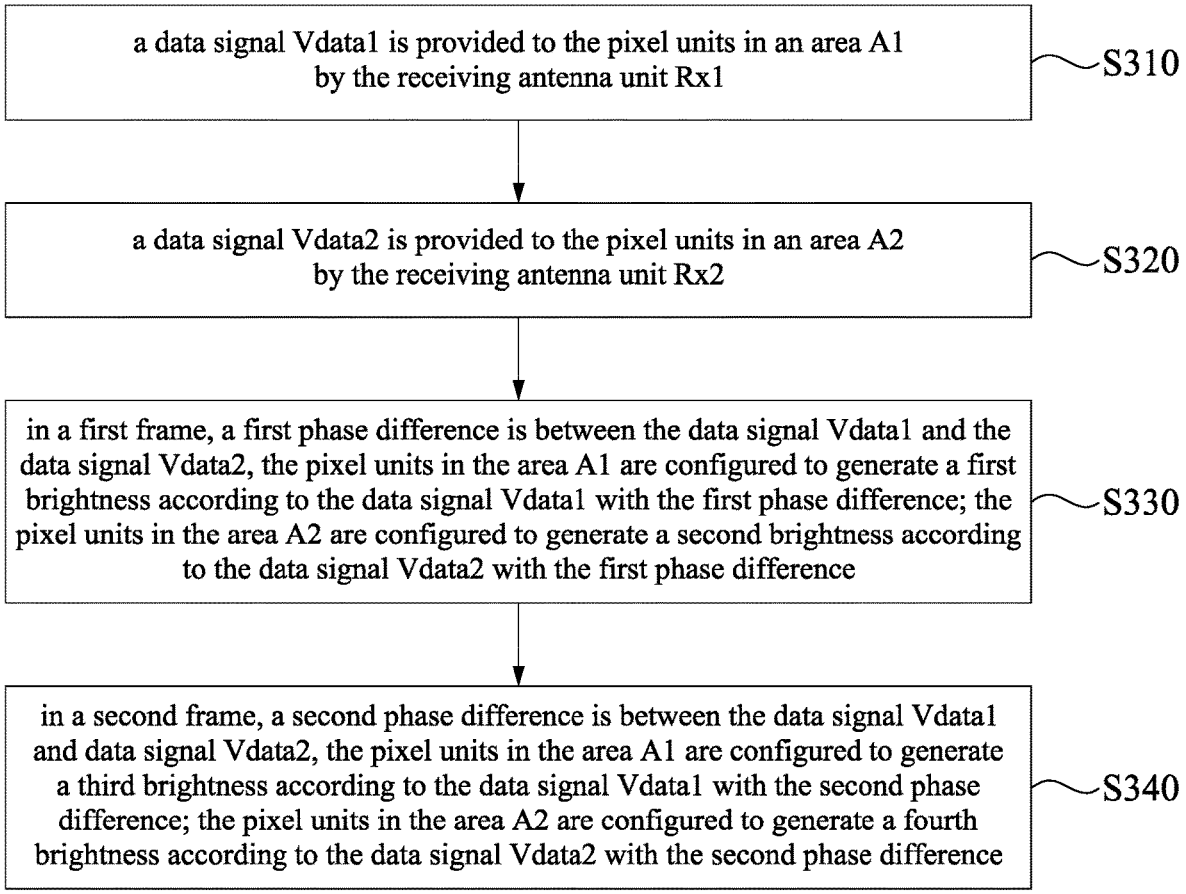
FIG. 3 is a flowchart illustrating a driving method of the display device according to an embodiment of the present disclosure.
Figure 4:
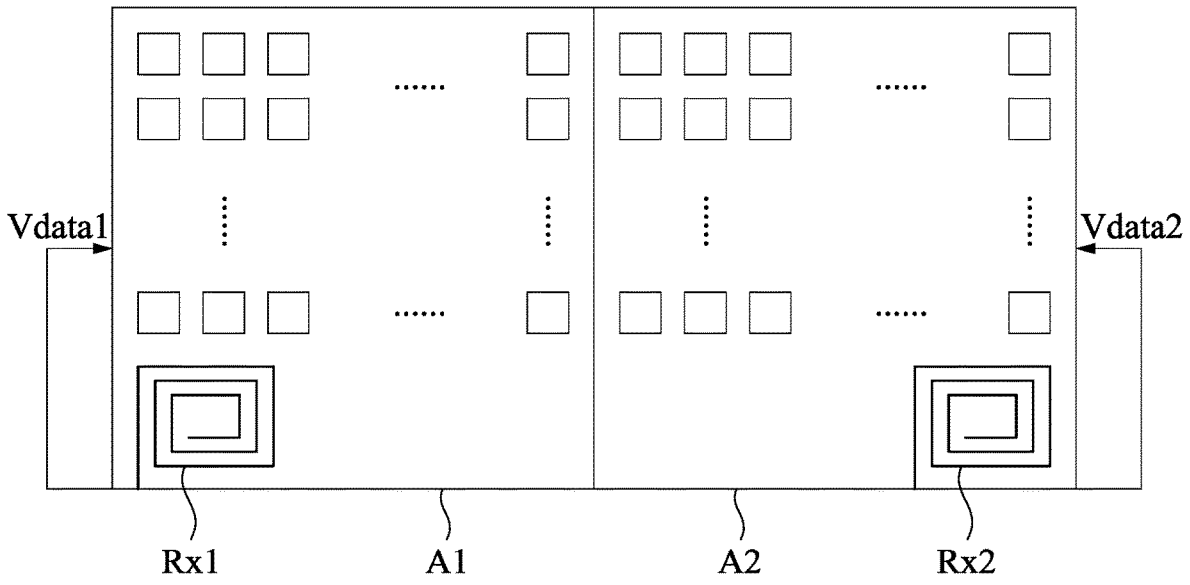
FIG. 4 is a schematic diagram illustrating an area A1, an area A2 and receiving antenna units according to an embodiment of the present disclosure.

Reference is made to the FIG. 3 and FIG. 4. FIG. 3 is a flowchart illustrating a driving method 300 for the display device according to an embodiment of the present disclosure, and FIG. 4 is a schematic diagram illustrating an area A1, an area A2 and receiving antenna units according to an embodiment of the present disclosure. As shown in FIG. 3, the driving method 300 for the display device performs step S310 and step S320 at first. Step S310 is performed by the receiving antenna unit Rx1 to provide a data signal Vdata1 to the pixel units located on the area A1. Step S320 is performed by the receiving antenna unit Rx2 to provide a data signal Vdata2 to the pixel units located on the area A2.

As mentioned above, as shown in FIG. 4, the adjacent areas A1 and A2 are demonstrated as an example. In FIG. 4, the area A1 includes the pixel units in a first part, and the area A2 includes the pixel units in a second part. The receiving antenna unit Rx1 is configured to provide data signal Vdata1 to the pixel units in the first part. The receiving antenna unit Rx2 is configured to provide the data signal Vdata2 to the pixel units in the second part.

Figure 5:
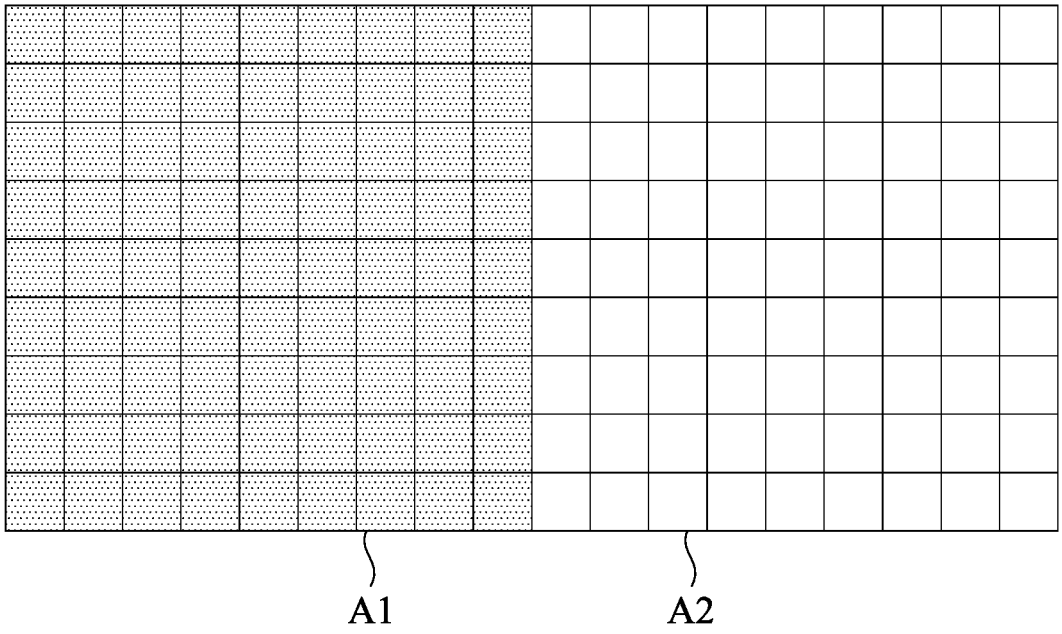
FIG. 5 is a schematic diagram illustrating a displayed state of the area A1 and the area A2 according to an embodiment of the present disclosure.

Reference is further made to FIG. 5. FIG. 5 is a schematic diagram illustrating a displayed state of the area A1 and the area A2 according to an embodiment of the present disclosure. As shown in FIG. 5, if the display device 100 is configured to display a red screen in which the gray level of (R, G, B) equals to (255, 0, 0), when the first part of the pixel units located in the area A1 receives the data signal Vdata1, the gray level of the first part of the pixel units will ideally be configured to be (255, 0, 0). Similarly, when the second part of the pixel units located in the area A2 receives the data signal Vdata2, the gray level of the second part of the pixel units will ideally be configured to be (255, 0, 0). However, signals transmitted over adjacent antennas may interfere with each other. Sometimes, aforesaid interference can be destructive, and it may disturb the data signal received by the pixel circuit and further deviate the gray-level displayed on the pixel circuit. In this case, when the pixel circuit displays the image (e.g., the red screen), the brightness on the pixel units on different areas (e.g., A1 and A2) may not be uniform. For example, the brightness of the area A1 is lower than the brightness of the area A2, as shown in FIG. 5.

As mentioned above, although the gray level to be displayed in the first part of the pixel units (located on the area A1) is desired to be the same as the gray level to be displayed in the second part of the pixel units (located on the area A2), the signals interfered with each other causing that the brightness displayed by the first part of the pixel units is different from the brightness displayed by the second part of the pixel units. Such that, to user's observation, one partial area on the display panel is relatively brighter and/or another partial area on the display panel is relatively darker.

Next, the driving method 300 for the display device performs step S330. During a first frame, a first phase difference exists between a data signal Vdata1 and a data signal Vdata2. The pixel units located on the area A1 are configured to generate a first brightness according to the data signal Vdata1 with the first phase difference. The pixel units located on the area A2 are configured to generate a second brightness according to the data signal Vdata2 with the first phase difference.

Figure 6:
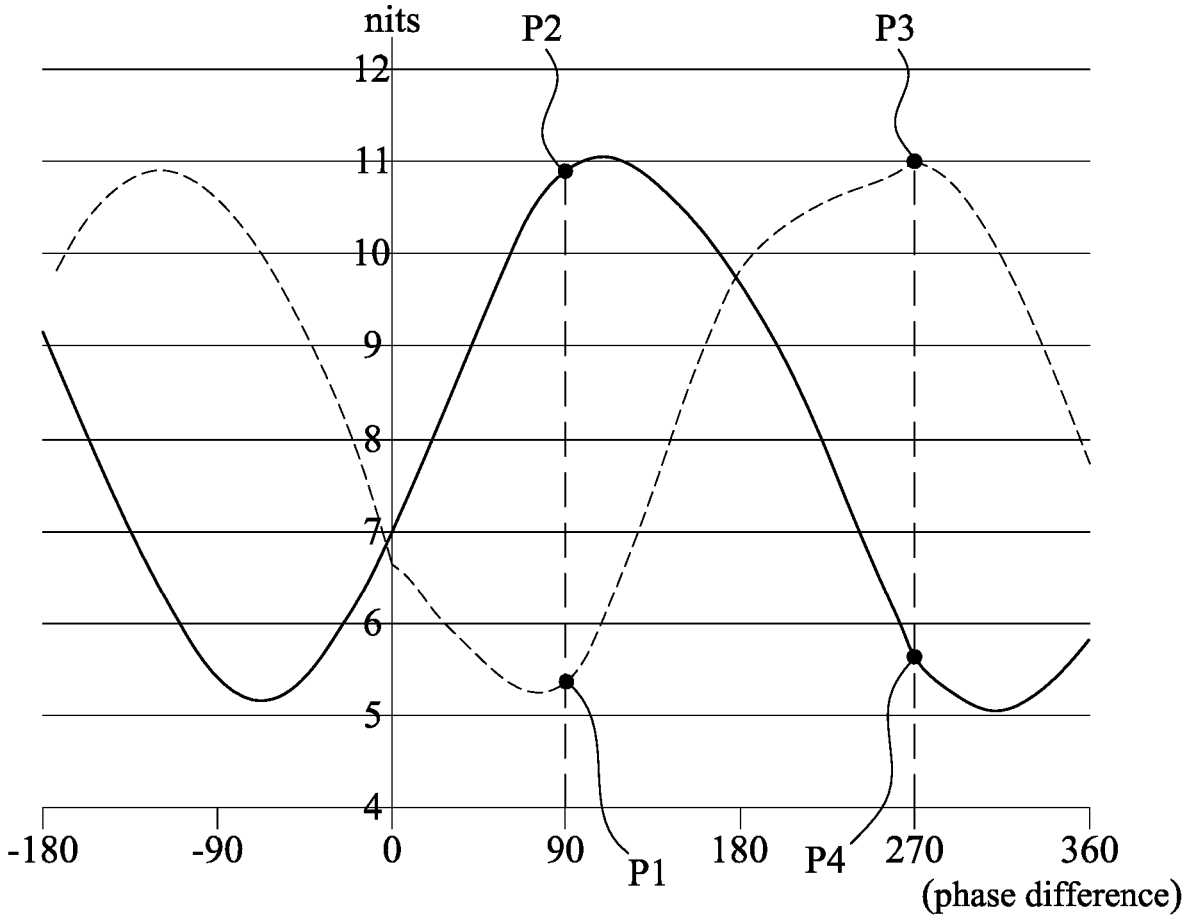
FIG. 6 is a schematic diagram illustrating a phase difference of a data signal Vdata1 and a data signal Vdata2 according to an embodiment of the present disclosure.

Reference is further made to the FIG. 6. FIG. 6 is a schematic diagram illustrating a phase difference of a data signal Vdata1 and a data signal Vdata2 according to an embodiment of the present disclosure. As shown in FIG. 6, a horizontal axis represents a relative phase difference between the data signals Vdata1 and Vdata2 received by the area A1 and area A2. A vertical axis represents the brightness (the unit of the vertical axis is nit). A dotted curve line represents the brightness variety of the area A1 in different phase differences (e.g., the relative phase difference between the data signals Vdata1 and Vdata2 varies from −180 to +360 as shown in FIG. 6). A solid curve line represents the brightness variety of the area A2 in different phase differences (e.g., the relative phase difference between the data signals Vdata1 and Vdata2 varies from −180 to +360 as shown in FIG. 6). Continuous to the aforesaid embodiment, during the first frame, the data signal Vdata1 and the data signal Vdata2 are configured to have the first phase difference in-between. In this case, the phase difference between the data signal Vdata1 and the data signal Vdata2 can be configured at 90 degree. Therefore, the pixel units located on the area A1 are configured to illuminate at a brightness value (about 5.2 nits) located at a coordinate point P1 according to the data signal Vdata1 with the first phase difference referring to the dotted curve line shown in FIG. 6. The pixel units located on the area A2 are configured to illuminate at another brightness value (about 10.8 nits) located at a coordinate point P2 according to the data signal Vdata2 with the first phase difference referring to the solid curve line shown in FIG. 6.

Next, the driving method 300 of the display device performs step S340, during a second frame, a second phase difference exists between the data signal Vdata1 and data signal Vdata2. The pixel units located on the area A1 illuminates at a third brightness according to the data signal Vdata1 with the second phase difference. The pixel units located on the area A2 illuminate at a fourth brightness according to the data signal Vdata2 with the second phase difference.

As shown in embodiments of FIG. 6, during the second frame, the data signal Vdata1 and the data signal Vdata2 are configured to have the second phase difference in-between. In this case, the phase difference between the data signal Vdata1 and the data signal Vdata2 can be configured at 270 degree. Therefore, the pixel units located on the area A1 are configured to illuminate at a brightness value (about 10.8 nits) located at a coordinate point P3 according to the data signal Vdata1 with the second phase difference referring to the dotted curve line shown in FIG. 6. The pixel units located on the area A2 are configured to generate a brightness value (about 5.2 nits) located at the coordinate point P4 according to the data signal Vdata2 with the second phase difference referring to the solid curve line shown in FIG. 6.

As mentioned above, the brightness of the pixel units located on the area A1 in the first frame is relatively darker, and the brightness of the pixel units located on the area A1 in the second frame is relatively brighter. An average brightness of the pixel units located on the area A1 in the first frame and the second frame is regarded as a brightness reference value (8 nits). Therefore, step S330 and step S340 are continuously performed in following frames. For example, the brightness of the pixel units located on the area A1 during a following third frame is relatively darker, and the brightness of the pixel units located on the area A1 in a following fourth frame is relatively brighter. Another average brightness of the pixel units located on the area A1 in the third frame and the fourth frame equals to the brightness reference value (8 nits), which is the average brightness of the pixel units located on the area A1 among the first frame and the second frame. In this way, the average brightness of the pixel units located on the area A1 at the brightness reference value in continuous frames can be maintained at a constant level. Similarly, the average brightness of the pixel units located on the area A2 is maintained at the brightness reference value in continuous frames. As a result, a user can views the pixel units in the areas A1 and A2 with constant brightness without experiencing flickers or non-uniform brightness. It is noted that, the brightness reference value could be adjusted according to practical applications, and therefore the present disclosure should not be limited to the brightness reference value (e.g., 8 nits) mentioned above.

It is noted that, the steps (such as step S330 and step S340) mentioned in the present embodiment can be performed in an alternative (or interchangeable) sequence unless the sequence of the operations is expressly indicated, and all or part of the steps may be simultaneously, partially simultaneously, or sequentially performed.

Figure 7:
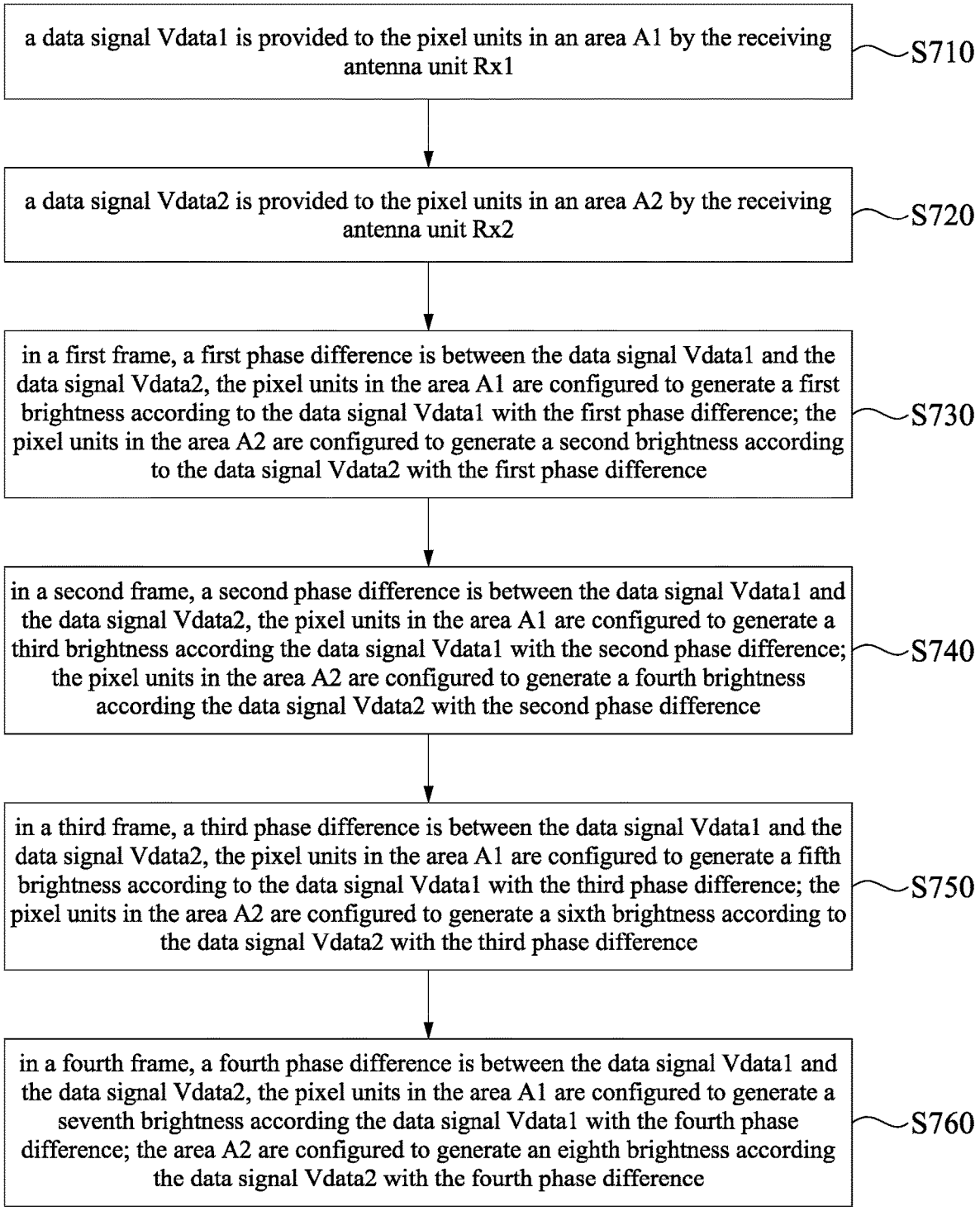
FIG. 7 is a flowchart illustrating a driving method of the display device according to an embodiment of the present disclosure.

In another embodiment, reference is made to FIG. 7. FIG. 7 is a flowchart illustrating a driving method 700 of the display device according to an embodiment of the present disclosure. As shown in FIG. 7, details about steps S710~S720 are similar to steps S310~S320 in aforesaid embodiments, and not further repeated here. The driving method 700 of the display device performs step S730 at first, during a first frame, a first phase difference exists between a data signal Vdata1 and a data signal Vdata2, the pixel units located on the area A1 are configured to illuminate a first brightness according to the data signal Vdata1 with the first phase difference; the pixel units located on the area A2 are configured to illuminate a second brightness according to the data signal Vdata2 with the first phase difference.

Figure 8:
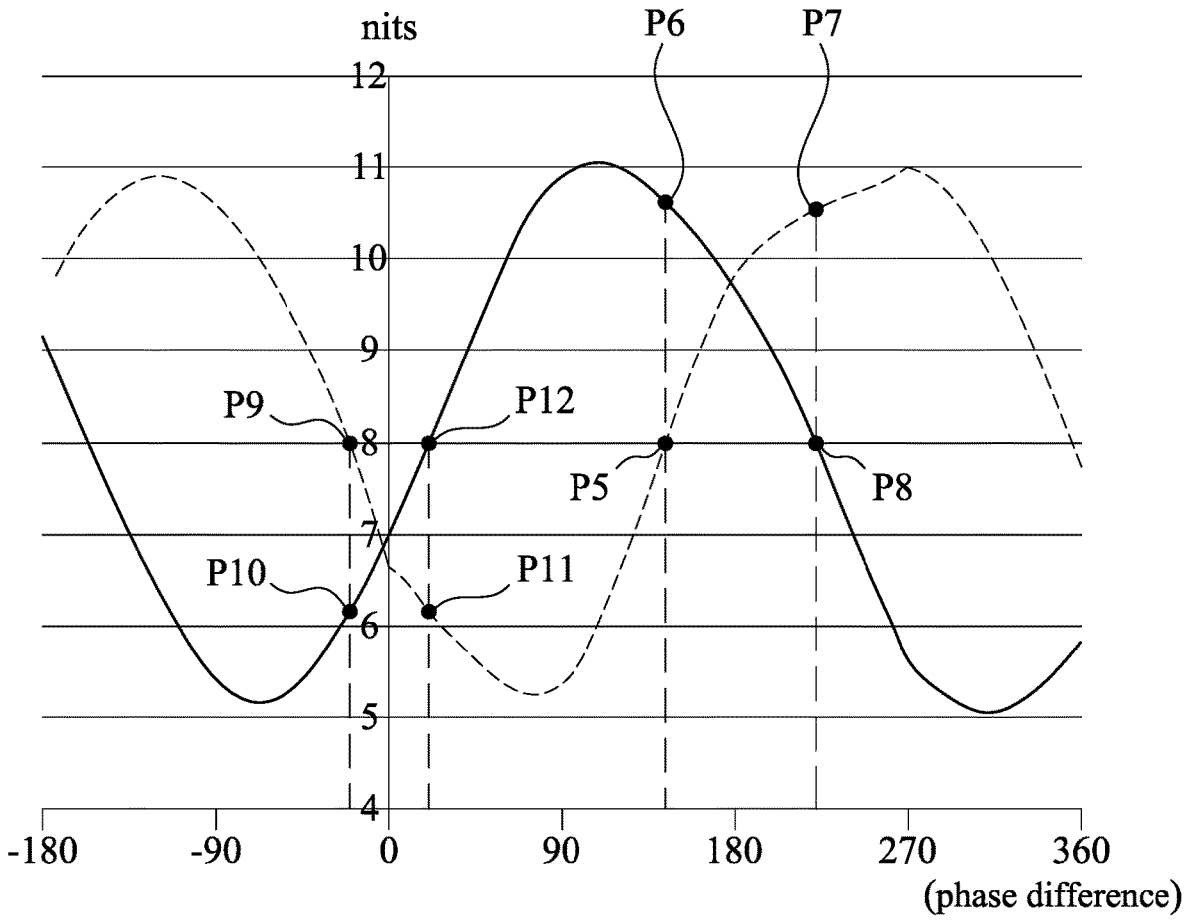
FIG. 8 is a schematic diagram illustrating a phase difference of the data signal Vdata1 and the data signal Vdata2 according to an embodiment of the present disclosure.

Reference is made to the FIG. 8. FIG. 8 is a schematic diagram illustrating a phase difference of the data signal Vdata1 and the data signal Vdata2 according to an embodiment of the present disclosure. As shown in FIG. 8, the horizontal axis represents a relative phase difference of the data signals Vdata1 and Vdata2 received by the area A1 and area A2. A vertical axis represents the brightness (the unit of the vertical axis is nits). A dotted curve line represents the brightness variety of the area A1 in different phase differences (e.g., the relative phase difference between the data signals Vdata1 and Vdata2 varies from −180 to +360 as shown in FIG. 8). A solid curve line represents the brightness variety of the area A2 in different phase differences (e.g., the relative phase difference between the data signals Vdata1 and Vdata2 varies from −180 to +360 as shown in FIG. 8). Continuous to the aforementioned embodiment, during the first frame, the data signal Vdata1 and the data signal Vdata2 are configured to have the first phase difference in-between. In this case, the phase difference between the data signal Vdata1 and the data signal Vdata2 can be configured at 160 degree. Therefore, the pixel units located on the area A1 are configured to illuminate a brightness value (about 8 nits) located at a coordinate point P5 according to the data signal Vdata1 with the first phase difference referring to the dotted curve line shown in FIG. 8. The pixel units of the area A2 are configured to illuminate at another brightness value (about 10.5 nits) located at a coordinate point P6 according to the data signal Vdata2 with the first phase difference referring to the solid line curve line in FIG. 8.

Next, the driving method 700 of the display device performs step S740, during a second frame, a second phase difference exists between the data signal Vdata1 and the data signal Vdata2. The pixel units located on the area A1 are configured to illuminate at a third brightness according the data signal Vdata1 with the second phase difference. The pixel units located on the area A2 are configured to illuminate at a fourth brightness according the data signal Vdata2 with the second phase difference.

As shown in embodiments of FIG. 8, during the second frame, the data signal Vdata1 and the data signal Vdata2 are configured to have the second phase difference in-between. In this case, the phase difference between the data signal Vdata1 and the data signal Vdata2 can be configured at 225 degree. Therefore, the pixel units located on the area A1 are configured to illuminate at a brightness value (about 10.5 nits) located at a coordinate point P7 according to the data signal Vdata1 with the second phase difference referring to the dotted curve line shown in FIG. 8. The pixel units located on the area A2 are configured to generate a brightness value (about 8 nits) located at a coordinate point P8 according to the data signal Vdata2 with the second phase difference referring to the solid curve line shown in FIG. 8.

Next, the driving method 700 for the display device performs step S750, during a third frame, the data signal Vdata1 and the data signal Vdata2 are configured to have a third phase difference in-between, the pixel units located on the area A1 are configured to illuminate at a fifth brightness according to the data signal Vdata1 with the third phase difference; the pixel units located on the area A2 are configured to illuminate at a sixth brightness according to the data signal Vdata2 with the third phase difference.

As shown in embodiments of FIG. 8, during the third frame, the data signal Vdata1 and the data signal Vdata2 are configured to have the third phase difference in-between. In this case, the phase difference between the data signal Vdata1 and the data signal Vdata2 can be configured at −20 degree. Therefore, the pixel units located on the area A1 are configured to illuminate a brightness value (about 8 nits) located at a coordinate point P9 according to the data signal Vdata1 with the third phase difference referring to the dotted curve line shown in FIG. 8. The pixel units located on the area A2 are configured to generate a brightness value (about 6.2 nits) located at a coordinate point P10 according to the data signal Vdata2 with the third phase difference referring to the solid curve line shown in FIG. 8.

Next, the driving method 700 of the display device performs step S760, during a fourth frame, the data signal Vdata1 and the data signal Vdata2 are configured to have the fourth phase difference in-between, the pixel units located on the area A1 are configured to illuminate at a seventh brightness according the data signal Vdata1 with the fourth phase difference; the area A2 are configured to illuminate at an eighth brightness according the data signal Vdata2 with the fourth phase difference.

Reference is made to FIG. 8 again, during the fourth frame, the data signal Vdata1 and the data signal Vdata2 are configured to have the fourth phase difference in between. In this case, the phase difference between the data signal Vdata1 and the data signal Vdata2 can be configured at 20 degree. Therefore, the pixel units located on the area A1 are configured to illuminate at a brightness value (about 6.2 nits) located at a coordinate point P11 according to the data signal Vdata1 with the fourth phase difference referring to the dotted curve line shown in FIG. 8. The pixel units located on the area A2 are configured to illuminate at a brightness value (about 8 nits) located at a coordinate point P12 according to the data signal Vdata2 with the fourth phase difference referring to the solid curve line shown in FIG. 8.

As mentioned above, the average brightness of the pixel units located on the area A1 and the average brightness of the pixel units located on the area A2 are both regarded as 8.175 nits from the first frame to the fourth frame, if the brightness reference value is regarded as 8 nits, the average brightness of the pixel units of the area A1 and the average brightness of the pixel units the area A2 from the first frame to the fourth frame are essentially equal to the brightness reference value. As a result, steps S730~S760 are continuously performed in continuous frames, such that the average brightness of the pixel units of the area A1 and area A2 at the brightness reference value in continuous frames can be maintained at a constant level. As a result, a user can views the pixel units in the areas A1 and A2 with constant brightness without experiencing flickers or non-uniform brightness.

It is noted that, the steps (such as step S730 to step S760) mentioned in the present embodiment can be performed in an alternative (or interchangeable) sequence unless the sequence of the operations is expressly indicated, and all or part of the steps may be simultaneously, partially simultaneously, or sequentially performed.

Figure 9:
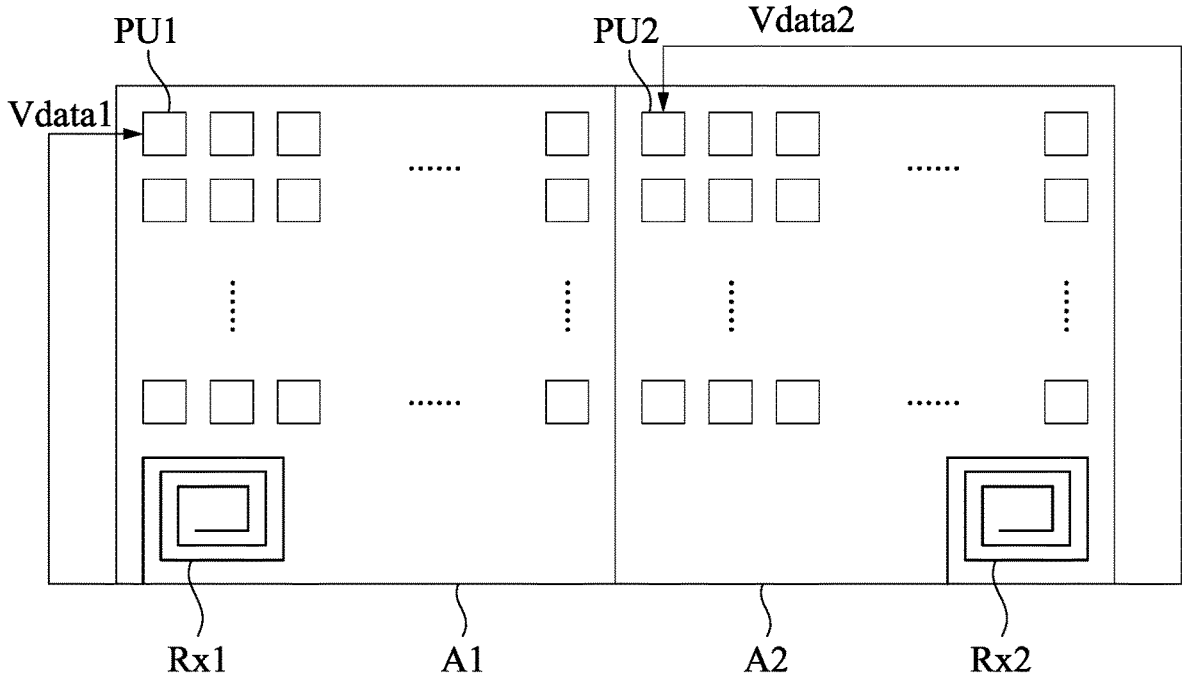
FIG. 9 is a schematic diagram illustrating pixel units and receiving antenna units in the area A1 and the area A2 according to an embodiment of the present disclosure.

In another embodiment, reference is made to FIG. 9. FIG. 9 is a schematic diagram illustrating pixel units and receiving antenna units of the area A1 and the area A2 according to an embodiment of the present disclosure. The adjacent areas of the area A1 and the area A2 are taken as an example. The area A1 includes a first part of the pixel units. The area A2 includes a second part of the pixel units. A receiving antenna unit Rx1 is configured to provide a data signal Vdata1 to one of the pixel units located on the first part PU1, a receiving antenna unit Rx2 is configured to provide the a data signal Vdata2 to one of the pixel units located on the second part PU2. According to the above embodiment, the pixel units located on the first part PU1 and the pixel PU2 located on the second part PU2 can also perform the steps of the driving method 300 and 700 of the display device. In this way, the average brightness of pixel units located on the first part PU1 and the pixel PU2 located on the second part PU2 is maintained at the brightness reference value in continuous frames. It is noted that, each of the pixel units of the area A1 and area A2 could all performs the steps of the driving method 300 and 700 of the display device; and therefore pixel units performing the steps of the driving method 300 and 700 of the display device should not be limited to the pixel units located on the first part PU1 and the pixels units located on the second part PU2.

In summary, the display device and the driving method thereof of the present disclosure mainly utilizes the phase difference between the individual signals to control the brightness of the display image. In this way, the average brightness of the display device in the continuous time can be maintained at a level roughly equal to the brightness reference value, such that continuous frames displayed on the display device may achieve constant brightness in user's vision.

Some words and phrases in the disclosure and the claim are utilized to indicate the specific element. However, people with common knowledge in the technical field may understand that the similarly element may use different nouns to indicate. The disclosure and the claim should distinguish the element based on the difference of the function of the element, instead of distinguishing the element in a manner according to the difference of nouns. In this document, the term "comprise" mentioned in the disclosure and claim is an open meaning language, such that the "comprise" should interpret as "comprise but not limit to". Additionally, in this document, the term "connect" includes any direct or indirect connection. Therefore, if the first element connect to the second element described in the disclosure represents that the first element may direct connect to the second element in a manner of the electrically connection or a manner of signal-coupled of wireless transmission, optical transmission, or the first element could be indirect or indirect connect to the second element by other element or manner.

Additionally, any singular terms may include plural means, singular means and simultaneously means, unless it is indicated in the disclosure.

Although the present invention has been described in considerable detail with reference to certain embodiments thereof, other embodiments are possible. Therefore, the spirit and scope of the appended claims should not be limited to the description of the embodiments contained herein.

What is claimed is:

1. A display device, comprising:

a pixel circuit disposed on an active area, wherein the pixel circuit comprises a plurality of pixel units; and a plurality of receiving antenna units electrically coupled to the pixel circuit, wherein the receiving antenna units comprise:

a first receiving antenna unit, configured to provide a first data signal to the pixel units in a first part for driving the pixel units in the first part to illuminate at a first brightness; and a second receiving antenna unit, configured to provide a second data signal to the pixel units in a second part for driving the pixel units in a second part to illuminate at a second brightness;

wherein, during a first frame, a first phase difference exists between the first data signal and the second data signal, the pixel units in the first part are configured to illuminate at the first brightness according to the first data signal with the first phase difference, the pixel units in the second part are configured to illuminate at the second brightness according to the second data signal with the first phase difference.

2. The display device of claim 1, wherein, during a second frame, a second phase difference exists between the first data signal and the second data signal, the pixel units in the first part are configured to illuminate at a third brightness according to the first data signal with the second phase difference, the pixel units in the second part are configured to illuminate at a fourth brightness according to the second data signal with the second phase difference.

3. The display device of claim 2, wherein an average value of the first brightness and the third brightness is regarded as a brightness reference value, wherein an average value between the second brightness and the fourth brightness equals to the brightness reference value.

4. The display device of claim 2, wherein, during a third frame, a third phase difference exists between the first data signal and the second data signal, the pixel units in the first part are configured to illuminate at a fifth brightness according to the first data signal with the third phase difference, the pixel units in the second part are configured to illuminate at a sixth brightness according to the second data signal with the third phase difference.

5. The display device of claim 4, wherein, during a fourth frame, a fourth phase difference exists between the first data signal and the second data signal, the pixel units in the first part are configured to illuminate at a seventh brightness according to the first data signal with the fourth phase difference, the pixel units in the second part are configured to illuminate at an eighth brightness according to the second data signal with the fourth phase difference.

6. The display device of claim 5, wherein an average value of the first brightness, the third brightness, the fifth brightness and the seventh brightness is regarded a brightness reference value, and an average value of the second brightness, the fourth brightness, the sixth brightness and the eighth brightness equals to the brightness reference value.

7. The display device of claim 1, wherein the pixel units in the first part are adjacent to the pixel units in the second part.

8. The display device of claim 1, further comprising:

a plurality of emission antenna units, comprising:

a first emission antenna unit, configured to provide the first data signal to the first receiving antenna unit; and a second emission antenna unit, configured to provide the second data signal to the second receiving antenna unit.

9. A display device, comprising:

a pixel circuit disposed on an active area, wherein the pixel circuit comprises a plurality of pixel units; and a plurality of receiving antenna units electrically coupled to the pixel circuit, wherein the receiving antenna units comprise:

a first receiving antenna unit configured to provide a first data signal to a first pixel unit of the pixel units in a first part, for driving the first pixel unit to illuminate at a first brightness; and a second receiving antenna unit, configured to provide a second data signal to a second pixel unit of the pixel units in a second part, for driving the second pixel unit to illuminate at a second brightness;

wherein, during a first frame, a first phase difference exists between the first data signal and the second data signal, the first pixel unit is configured to illuminate at the first brightness according to the first data signal with the first phase difference, the second pixel unit is configured to illuminate at the second brightness according to the second data signal with the first phase difference.

10. The display device of claim 9, wherein, during a second frame, a second phase difference exists between the first data signal and the second data signal, the first pixel unit is configured to illuminate at a third brightness according to first data signal with the second phase difference, the second pixel unit is configured to illuminate at a fourth brightness according to the second data signal with the second phase difference.

11. The display device of claim 10, wherein an average value of the first brightness and the third brightness is regarded as a brightness reference value, an average value of the second brightness and the fourth brightness equals to the brightness reference value.

12. The display device of claim 10, wherein, during a third frame, a third phase difference exists between the first data signal and the second data signal, the first pixel unit is configured to illuminate at a fifth brightness according to the first data signal with the third phase difference, the second pixel unit is configured to illuminate at a sixth brightness according to the second data signal with the third phase difference.

13. The display device of claim 12, wherein during a fourth frame, a fourth phase difference exists between the first data signal and the second data signal, the first pixel unit is configured to illuminate at a seventh brightness according to the first data signal with the fourth phase difference, the second pixel unit is configured to illuminate at an eighth brightness according to the second data signal with the fourth phase difference.

14. The display device of claim 13, wherein an average value of the first brightness, the third brightness, the fifth brightness and the seventh brightness is regarded as a brightness reference value, and an average value of the second brightness, the fourth brightness, the sixth brightness and the eighth brightness equals to the brightness reference value.

15. The display device of claim 9, wherein the pixel units in the first part are adjacent to the pixel units in the second part.

16. The display device of claim 9, further comprising:

a plurality of emission antenna units, comprising:

a first emission antenna unit, configured to provide the first data signal to the first receiving antenna unit; and a second emission antenna unit, configured to provide the second data signal to the second receiving antenna unit.

17. A driving method, suitable for a display device, the driving method comprising:

providing a first data signal by a first receiving antenna unit to a plurality of pixel units in a first part;

providing a second data signal by a second receiving antenna unit to a plurality of pixel units in a second part; and wherein, during a first frame, a first phase difference exists between the first data signal and the second data signal, the pixel units in the first part are configured to illuminate at the first brightness according to the first data signal with the first phase difference, the pixel units in the second part are configured to illuminate at the second brightness according to the second data signal with the first phase difference.

18. The driving method of claim 17, wherein, during a second frame, a second phase difference exists between the first data signal and the second data signal, the pixel units in the first part are configured to illuminate at a third brightness according to the first data signal with the second phase difference, the plurality of pixel units in the second part are configured to illuminate at a fourth brightness according to the second data signal with the second phase difference.

19. The driving method of claim 18, wherein an average value of the first brightness and the third brightness is regarded as a brightness reference value, and an average of the second brightness and the fourth brightness equals to the brightness reference value.

20. The driving method of claim 18, wherein, during a third frame, a third phase difference exists between the first data signal and the second data signal, the pixel units in the first part are configured to illuminate at a fifth brightness according to the first data signal with the third phase difference, the pixel units in the second part are configured to illuminate at a sixth brightness according to the second data signal with the third phase difference.

21. The driving method of claim 20, wherein, during a fourth frame, a fourth phase difference exists between the first data signal and the second data signal, wherein the pixel units in the first part are configured to illuminate at a seventh brightness according to the first data signal with the fourth phase difference, the pixel units in the second part are configured to illuminate at an eighth brightness according to the second data signal with the fourth phase difference.

22. The driving method of claim 21, wherein an average value of the first brightness, the third brightness, the fifth brightness and the seventh brightness is regarded as a brightness reference value, and an average value of the second brightness, the fourth brightness, the sixth brightness and the eighth brightness equals to the brightness reference value.

* * * * *